US011266242B1

(12) United States Patent
Tooley

(10) Patent No.: US 11,266,242 B1
(45) Date of Patent: Mar. 8, 2022

(54) MOUNTING METHOD AND APPARATUS

(71) Applicant: Norcros Group (Holdings) Limited, Hampshire (GB)

(72) Inventor: Jonathan Harry Tooley, Hampshire (GB)

(73) Assignee: Norcros Group (Holdings) Limited, Hampshire (GB)

( * ) Notice: Subject to any disclaimer, the term of this patent is extended or adjusted under 35 U.S.C. 154(b) by 0 days.

(21) Appl. No.: 17/087,798

(22) Filed: Nov. 3, 2020

(51) Int. Cl.

| | |
|---|---|
| ***A47B 67/00*** | (2006.01) |
| ***A47B 67/02*** | (2006.01) |
| ***A47B 96/06*** | (2006.01) |
| ***A47B 95/00*** | (2006.01) |
| ***E04F 19/08*** | (2006.01) |

(52) U.S. Cl.
CPC ..... *A47B 96/06* (2013.01); *A47B 67/005* (2013.01); *A47B 67/02* (2013.01); *A47B 95/008* (2013.01); *E04F 19/08* (2013.01)

(58) Field of Classification Search
CPC ..... A47B 96/06; A47B 96/00; A47B 67/02; A47B 67/005; A47B 95/08; E04F 19/08
See application file for complete search history.

(56) References Cited

U.S. PATENT DOCUMENTS

| | | | | | |
|---|---|---|---|---|---|
| 1,850,292 | A * | 3/1932 | Skelly | E04F 19/08 | 220/477 |
| 3,620,404 | A * | 11/1971 | Grasso | E04F 19/08 | 220/477 |
| 3,791,709 | A * | 2/1974 | Cross | A47B 95/008 | 312/245 |
| 4,576,355 | A * | 3/1986 | Graf | A47B 95/008 | 248/544 |
| 5,570,938 | A * | 11/1996 | Butler | A47K 10/22 | 211/59.1 |
| 5,707,125 | A * | 1/1998 | Coglin | A47B 95/008 | 312/242 |
| 5,738,020 | A * | 4/1998 | Correia | A47B 95/008 | 109/51 |
| 2003/0127955 | A1 | 7/2003 | Johnson | | |
| 2017/0038058 | A1* | 2/2017 | Cano | F21V 33/0012 | |
| 2018/0235366 | A1* | 8/2018 | Pyle | A47B 95/008 | |

FOREIGN PATENT DOCUMENTS

| | | | | |
|---|---|---|---|---|
| AU | 2012202034 | | 10/2012 | |
| EP | 3695748 | A1 * | 8/2020 | E04F 19/08 |
| EP | 3540136 | B1 * | 11/2020 | E04F 19/08 |

* cited by examiner

*Primary Examiner* — Kimberley S Wright
(74) *Attorney, Agent, or Firm* — Dinsmore & Shohl LLP

(57) ABSTRACT

A method is provided for mounting an item of furniture, and in particular a cabinet, in a cavity formed in wall cladding. The arrangement is such that part of the item of furniture is held against an outer surface of the cladding by fixing elements that are displaced into engagement with an inner face of the wall cladding. The fixing elements are displaced into position from the interior of the cabinet.

12 Claims, 4 Drawing Sheets

MOUNTING METHOD AND APPARATUS

FIELD OF THE INVENTION

This invention relates to a method of and/or apparatus for mounting furniture on a substantially vertical surface such as a wall. In this context 'furniture should be interpreted as including (but not necessarily be restricted to) cabinets, cupboards, shelves, mirrors, and brackets on or with which other components may be mounted or engaged.

BACKGROUND OF THE INVENTION

In our British Patent GB2427119 we describe and claim apparatus for mounting and levelling furniture on a vertical wall surface. Whilst the arrangement described is simple to use, it is relatively costly to manufacture and requires a rebated surface on the rear of the furniture item if the furniture item is to be fitted flush against the wall. Further, the level must be established before the furniture item is placed into position on the wall and the horizontal spacing between the fixings that attach the apparatus to the wall, is substantially fixed. This latter feature limits the positioning of heavier components to walls that require the apparatus to be fixed through the wall and into vertical studs supporting the wall.

Some furniture items such as, for example, bathroom cabinets, are required to be fitted into a cavity formed in a panel or cladding applied a stud wall. Heretofore this has required the desired position to be established and a cavity beneath the desired position to be exposed by forming an aperture in the wall cladding. In some instances, part of a stud may pass through the cavity and this must be removed to allow insertion of the cabinet. A liner then needs to be constructed which can be fixed into the cavity to receive the carcass of the cabinet. Once the liner is in place the cabinet can be inserted and screws passed, from the interior of the cabinet, through the cabinet walls to engage in the liner. This process requires skilled carpentry and is beyond the abilities of most amateur handy-persons.

Two arrangements specifically designed for mounting a cabinet in a cavity formed in a wall panel are described in US Patent Application Publication No. 2003/0127955, the cabinet having an outer peripheral rim which overlies a margin around the cavity and contacts the outer face of the wall panel. In one embodiment spring biased tabs are provided which project outwardly from the outer surfaces of side panels of the cabinet. As the cabinet is inserted into the cavity, the tabs are deformed inwardly but recover when the cabinet is fully inserted and contact edges on the tabs bear against the inner face of the wall panel and draw the peripheral rim against the outer face of the panel to fix the cabinet in place. Whilst this arrangement is simple and largely effective, the distance between the contact edges and the peripheral rim is fixed and thus, different cabinets must be provided depending on the thickness of wall panel to which the cabinet is to be mounted. Further, once the cabinet is mounted, it is difficult, if not impossible, to remove it from the wall cavity without damaging either the wall panel and/or the cabinet fixings.

An alternative embodiment is described in which 90-degree-rotatable screw fasteners are employed. These fasteners are mounted on screws inserted through apertures provided in the peripheral rim and are rotatable between insert and fixing positions. Whilst this latter arrangement allows the cabinet to be removed from the wall cavity without damage, again the spacings between the fasteners and the rim are fixed, meaning that different configurations must be provided for different thicknesses of wall panel.

It is an object of the invention to provide a method and apparatus that will go at least some way in addressing the drawbacks mentioned above; or which will at least provide a novel and useful alternative.

SUMMARY OF THE INVENTION

Accordingly, in one aspect, the invention provides a method of fixing an item of furniture in a cavity in a wall panel, the wall panel having an outer face and an inner face, the item of furniture comprising a hollow body having an insertion axis along which, in use, the hollow body is inserted into the cavity; an interior and an exterior, a position datum fixed to the hollow body, and a plurality of elongate slots aligned generally in the direction of the insertion axis and connecting the interior with the exterior, wherein the method comprises inserting the hollow body in the cavity; positioning fixings against the exterior of the body and positioning locking means against the interior of the body, such that the fixings are connected to the locking means through the elongate slots; displacing the locking means and fixings relative to the elongate slots so that said fixings are brought into contact with the inner face of the wall panel while the position datum is displaced into contact with the outer face of the wall panel; and using the locking means to lock the fixings against the exterior.

Preferably the method comprises passing the fixings through the elongate slots after the body has been inserted through the cavity.

Preferably the method comprises effecting relative displacement between the fixings and the locking means to simultaneously lock the fixings to the exterior of the body and the locking means to the interior of the body.

In a second aspect the invention provides an item of furniture for insertion in a cavity in a wall panel, the item of furniture comprising a hollow body having an insertion axis along which, in use, the hollow body is inserted into the cavity; an interior and an exterior, a position datum fixed to the hollow body, the position datum being located and configured to, in use, engage with the wall panel to limit the displacement of the body relative to the wall panel along the insertion axis, wherein the item of furniture further comprises a plurality of elongate slots in the body, the slots being aligned generally in the direction of the insertion axis; a plurality of fixings positioned against the exterior of the body and locking means positioned against the interior of the body, the fixings being connected to the locking means through the elongate slots, and wherein, in a first configuration the locking means and fixings are displaceable relative to the slots and, in a second configuration, are fixed relative to the slots.

Preferably the hollow body is rectangular in form and is of substantially constant depth extending between a front edge and a rear edge.

Preferably the rectangular body comprises a base attached to or forming the rear edge; and opposed side walls, top and bottom extending from the base to define an opening at the front edge.

Preferably the position datum comprises a peripheral flange extending outwardly from said front edge.

Preferably the elongate slots are formed in the opposed side walls.

Preferably each of the slots comprises a first section merging in the direction of the insertion axis into a second section, and wherein the first section is of greater dimension than the second section in a direction perpendicular to the insertion axis.

Preferably the locking means comprises a plate that at least partly overlies the respective elongate slot.

Preferably the plate has a centreline, and wherein the connection between the plate and a fixing is offset from the centreline.

Preferably the item of furniture comprises a cabinet.

Many variations in the way the present invention can be performed will present themselves to those skilled in the art. The description which follows describes one or more examples only of combinations of elements or components for performing the invention. Within the limits of the appended claims one, more or all of the described elements could be substituted to provide an embodiment of the invention and the invention is not to be confined to the combinations, whether in whole or in part, to those described.

BRIEF DESCRIPTION OF THE DRAWINGS

One working embodiment of the invention will now be described with reference to the accompanying drawings in which.

DETAILED DESCRIPTION OF THE INVENTION

Figure 1:
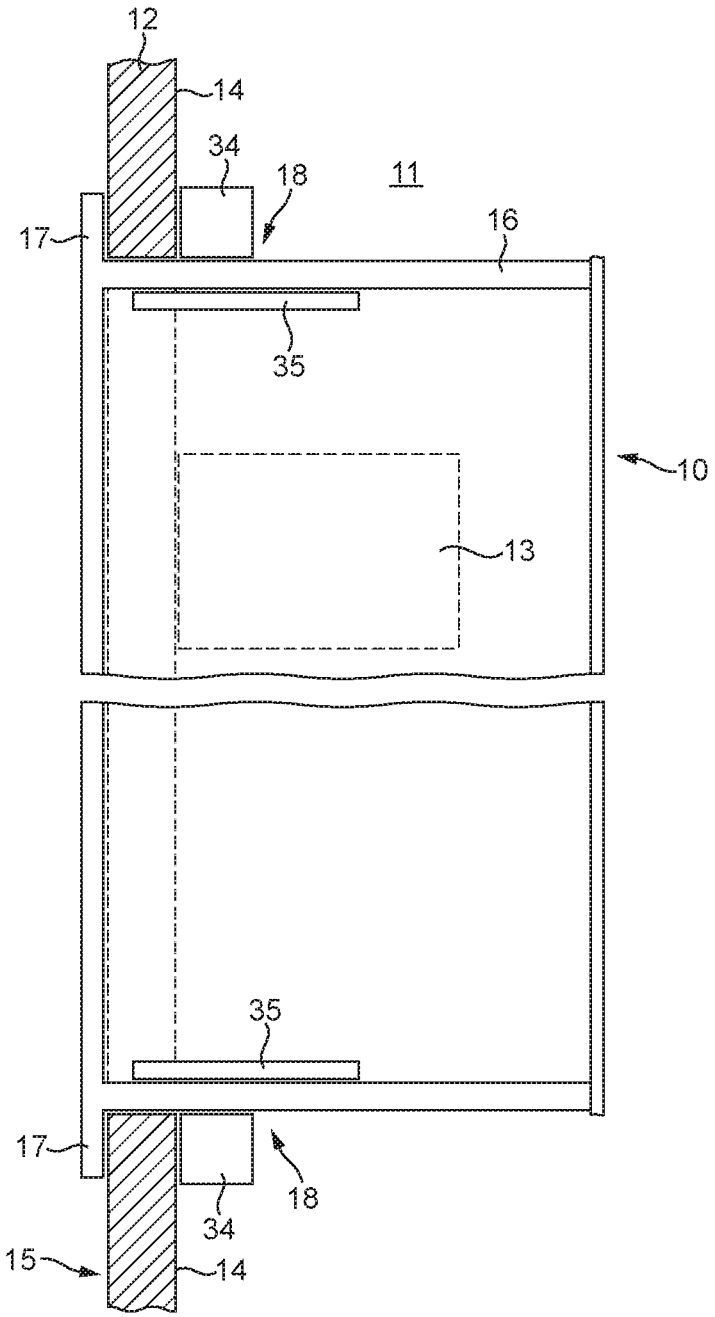
FIG. 1 is a schematic horizontal cross-section of an item of furniture according to the invention, in the form of a cabinet, in place in a wall cavity.
Figure 2:
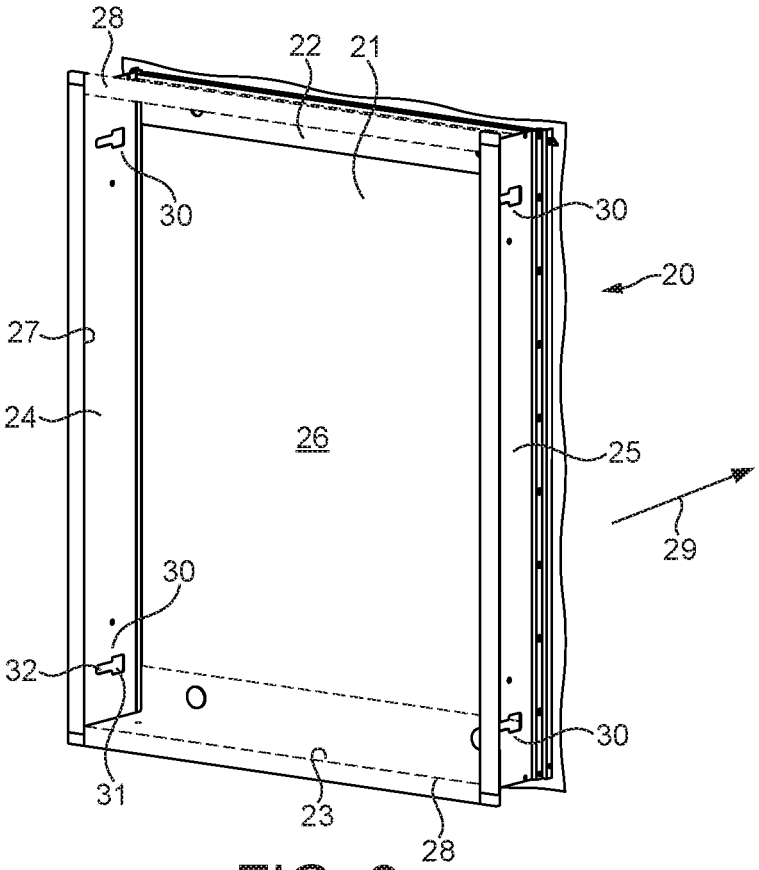
FIG. 2 is a frontal isometric view of a cabinet according to the invention in a position of use.

Referring firstly to FIG. 1, the invention provides a simple yet effective means of mounting an item of furniture 10 in a cavity 11 exposed by an aperture in a panel or cladding applied to a stud wall, that is to say a wall comprising cladding 12 fixed to spaced vertical studs, one of which is shown in dotted outline at 13. In the well-known manner, the inner face 14 of the cladding engages the studs while the outer face 15 provides the visible wall surface. In this example the item of furniture 10 comprises a hollow body 16 that locates within the cavity, and spaced contact surfaces 17 that project from the body 16 to overlie parts of outer face 15 of the wall, the contact surfaces 17 serving as a position datum that limits the degree to which the hollow body 16 can be inserted into the cavity 11. As will be described in greater detail below, fixing means 18 are mounted on an exterior of the body 16 in the manner such that they can be displaced relative to the body, from the interior of the body, against the inner face 14 of the cladding. This, in turn, clamps the contact surfaces 17 against the outer cladding face 15.

As used herein the term 'item of furniture' should be interpreted in its broadest sense and to include (but not necessarily be restricted to) a cupboard, a cabinet, a shelving unit, and a support for mounting other wall-mounted items. However, for explanatory purposes, the following description is to be directed to the invention when applied to a cabinet intended for mounting within cavity 11.

Turning now to FIGS. 2 to 6, a typical bathroom cabinet 20 is shown, the carcass of which in this case is formed from sheet aluminium although the use of this material is by no means essential. The cabinet 20 includes a back or base 21 from which project top 22, bottom 23 and spaced sides 24 and 25. The combination of back 21, top 22, bottom 23 and sides 24 & 25 define an interior volume 26 and the outer or free edges of the wall components combine to define an opening 27 to the volume 26. An outwardly directed peripheral lip or flange 28 surrounds the opening 27 and a door (not shown) may be fitted into the opening 27. The lip or flange 28 includes and/or defines the position datum.

The cabinet 20 has an insertion axis 29 along which the cabinet is inserted into cavity 11.

In the form shown, mounting slots 30 are provided in sides 24 & 25 of the cabinet that are at least generally aligned in the direction of the insertion axis 29 and, in the particular form shown, are aligned parallel to the insertion axis. In this example at least one slot 30 is required in each of sides 24 & 25 and preferably two are provided, one adjacent to top 22 and one adjacent to bottom 23. Each slot is preferably identical and is defined by a first section 31 and a second section 32, the section 31 merging into the section 32 in the direction of the insertion axis 29 and being of a greater width than the section 32.

Figure 3:
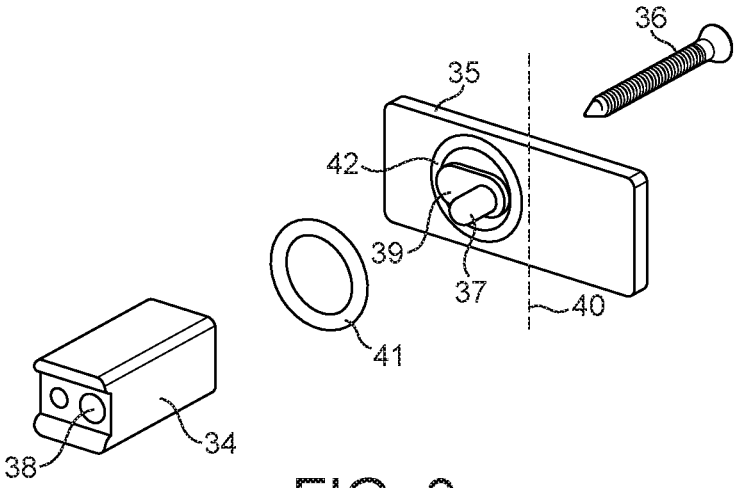
FIG. 3 is an exploded view of fixing means configured for use with the cabinet shown in FIG. 2.

The fixing means 18 is configured so that it can be positioned in place and displaced into a locking position entirely from within the interior volume 26 yet those parts that provide the locking action to the inner cladding surface can be hidden from view. As shown in FIG. 3 the fixing means 18 comprises a locking stud 34 and a positioning or locking tab 35 that is fixed to the locking stud 34 by any suitable fastening such as screw 36. The locking tab 35 includes a spigot 37 that engages within bore 38 in the locking stud 34 to lock the stud 34 against rotation relative to the locking tab 35. As can be seen in FIG. 3, locking tab 35 the positions of the screw fixing and the spigot 37 are offset from the centreline 40 of the locking tab, and the diameter of the spigot is a clearance fit within part 32 of the slot 30, allowing the screw and spigot to slide along part 32 of the slot but preventing rotation of the locking tab relative to the slot. To further ensure pure sliding action of the locking tab 35 in part 32 of the slot, a lozenge-shape boss 39 may be formed about the base of spigot 37, the vertical dimension of the boss being a sliding fit in part 32 of the slot. It will be further noted that the locking stud 34 is dimensioned to pass through part 31 of the slot 30. Finally, this particular embodiment of fixing means includes a resilient O-ring 41 that locates in groove 42 on the inner surface of the locking tab 35 to increase the frictional engagement of the locking tab 35 with the cabinet sides 24 & 25.

Figure 4:
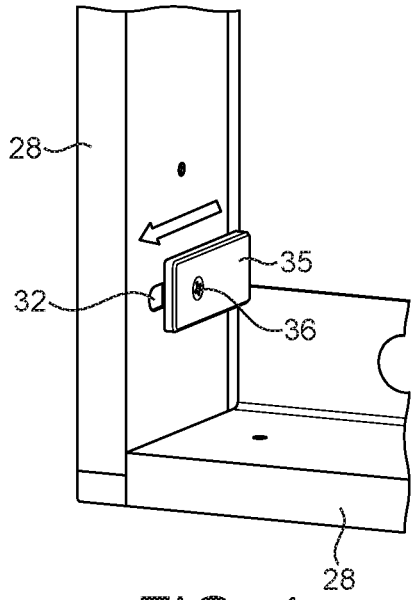
FIG. 4 is an enlarged isometric view of a fixing means shown in FIG. 3 in place on an inside of a wall of the cabinet shown in FIG. 3.
Figure 5:
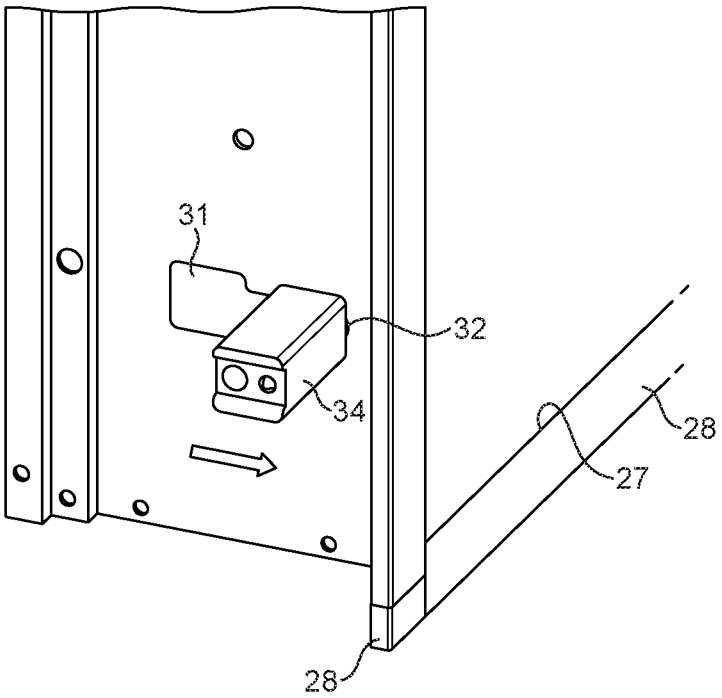
FIG. 5 is a reversed isometric view showing the assembly of FIG. 4 but on the outside of a wall of the cabinet.

The fixing means 35 shown in FIG. 3 is shown assembled to the cabinet side 24 in FIGS. 4 & 5, it being appreciated that the assembly of the fixing means to the cabinet side 25 is simply a mirror image of what is shown. When assembled, the locking stud 34 of the fixing means is concealed in the cavity 11, the only part being visible within the cabinet being the locking tab 35. If desired, this can be provided with an aesthetically pleasing cover (not shown).

A sequence of fitting cabinet 20 into a wall cavity is shown in FIGS. 6A to 6F. Firstly, an aperture is created in the wall cladding to expose the cavity in which the cabinet is to be fitted. As with prior art applications the cavity should be sufficiently large to receive the periphery of the cabinet carcass defined by the outer surfaces of top 22, bottom 23 and sides 24 & 25, but sufficiently small to be overlaid by peripheral flange 28. In the event a stud 13 passes through the position selected for the cavity, a part must be removed to allow the cabinet to be inserted. In this event, it is preferred that the upwardly facing edge of the stud section remaining following removal of part of the stud, is horizontal and substantially flush with the bottom edge of the formed aperture so that the stud can add vertical support to the cabinet, once installed. In the absence of a stud, the cabinet may rest substantially on the lower edge of the aperture in the wall cladding.

Figure 6A:
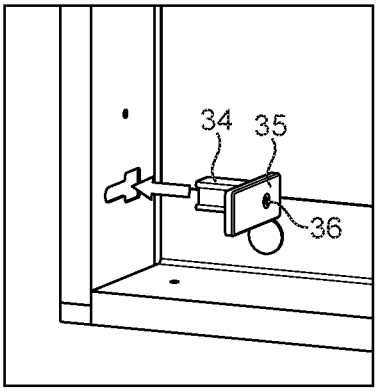
FIGS. 6A to 6F are a sequence of images of steps taken to fit the cabinet of FIGS. 1 to 5 in place in a wall cavity.
Figure 6B:
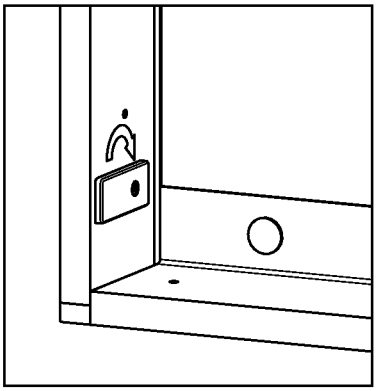
Figure 6C:
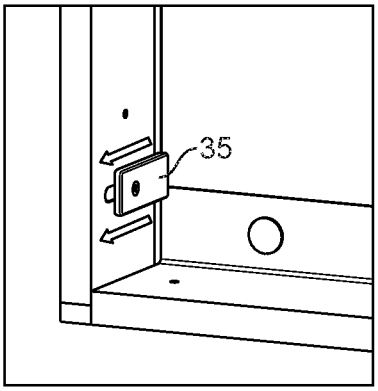
Figure 6D:
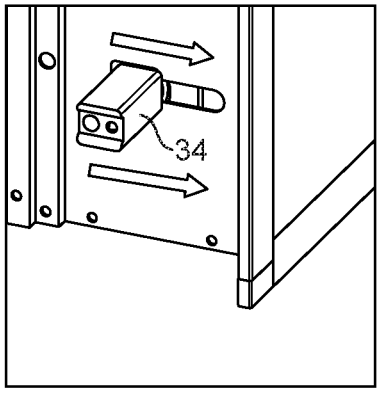
Figure 6E:
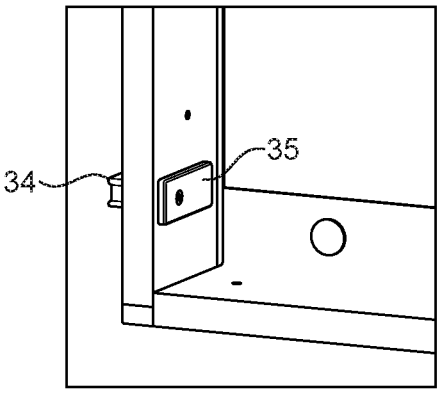
Figure 6F:
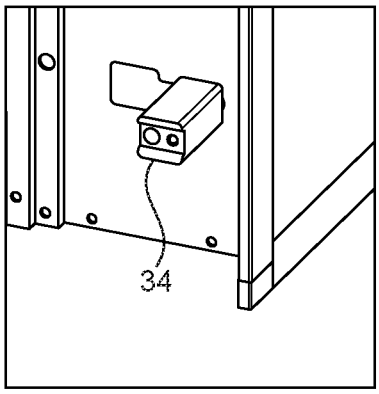

With the cavity prepared, the cabinet is inserted along insertion axis 29 until the flange 28 contacts the wall cladding surrounding the formed aperture. The locking tab 35 is loosely fitted to the locking stud 34 and the stud then passed through part 31 of the slot 30 to locate within the cavity 11. In FIG. 6A, the offset attachment of the stud 34 to the tab 35 is shown positioned closer to the rear of the cabinet meaning that the fixing means is configured for thicker wall claddings. If the fixing means is to be used with thinner wall claddings, the assembly is rotated as shown in FIG. 6B, while still positioned to the rear of slot 30, so that the offset is now closer to the front of the cabinet. Regardless of the position of the offset, the locking tab 35 is preferably dimensioned so that the slot 30 is covered when the cabinet is locked in place.

With the locking tab and locking stud assembled and positioned within slot 30 such that some friction is generated between the cabinet side and the O-ring 41, the assembly can be displaced forward, in the direction shown by the arrows in FIGS. 4, 5, 6C & 6D until the stud 34 buts up against the inner face of the wall cladding. Thereafter the screw 36 is further tightened to lock the fixing means relative to the cabinet side and thus, in turn, retain the cabinet within the cavity.

Those skilled in the art will appreciate that many variations to the embodiment described could be realised without departing from the scope of the invention. By way of example only, the fixing means could, alternatively or in addition, be fitted to the top 22 and bottom 23 of the cabinet. Further, while the linear sliding action between the fixing means and the cabinet carcass is a simple and convenient way of providing the necessary relative adjustment, alternative relative movements, including cam-based actions, could be employed.

It will thus be appreciated that the invention, at least in the case of the particular embodiment described, provides a simple yet effective method and apparatus that allows persons of limited skill to effectively and accurately mount furniture items in cavities in stud walls while offering more skilled people a method and/or apparatus that can substantially reduce the time required to perform such tasks.

The invention claimed is:

1. A method of fixing an item of furniture in a cavity in a wall panel, the wall panel having an outer face and an inner face, the method comprising:

providing the item of furniture comprising:

a hollow body having an insertion axis along which, in use, the hollow body is inserted into the wall panel cavity;

the hollow body having a body wall, an interior and an exterior;

a position datum fixed to the hollow body; and a plurality of elongate slots in the body wall aligned generally in the direction of the insertion axis and connecting the interior with the exterior;

inserting the hollow body in the wall panel cavity;

positioning fixings against the exterior of the body and positioning locking elements against the interior of the body, such that the fixings are connected to the locking elements through the elongate slots;

displacing the locking elements and fixings along the elongate slots so that said fixings are brought into contact with the inner face of the wall panel while the position datum is displaced into contact with the outer face of the wall panel; and using the locking elements to lock the fixings against the exterior.

2. The method of claim 1, further comprising passing the fixings through the elongate slots after the body has been inserted through the cavity.

3. The method of claim 1, further comprising effecting relative displacement between the fixings and the locking elements to simultaneously lock the fixings to the exterior of the body and the locking elements to the interior of the body.

4. An item of furniture for insertion in a cavity in a wall panel, the item of furniture comprising:

a hollow body having an insertion axis along which, in use, the hollow body is inserted into the cavity;

the hollow body having a body wall, an interior and an exterior;

a position datum fixed to the hollow body, the position datum being located and configured to, in use, engage with the wall panel to limit the displacement of the body relative to the wall panel along the insertion axis;

a plurality of elongate slots in the body wall, the slots being aligned generally in the direction of the insertion axis; and a plurality of fixings positioned against the exterior of the body and locking elements positioned against the interior of the body, the fixings being connected to the locking elements through the elongate slots;

wherein, in a first configuration, the locking elements and fixings are displaceable along the slots and, in a second configuration, are fixed relative to the slots.

5. The item of furniture of claim 4, wherein the hollow body is rectangular in form and is of substantially constant depth extending between a front edge and a rear edge.

6. The item of furniture of claim 5, wherein said rectangular body comprises a base attached to or forming the rear edge, and opposed side walls, top and bottom extending from the base to define an opening at the front edge.

7. The item of furniture of claim 5, wherein the position datum comprises a peripheral flange extending outwardly from said front edge.

8. The item of furniture as claimed in claim 6, wherein said elongate slots are formed in the opposed side walls.

9. The item of furniture of claim 5, wherein each of the slots comprises a first section merging in the direction of the insertion axis into a second section, and wherein the first section is of greater dimension than the second section in a direction perpendicular to the insertion axis.

10. The item of furniture of claim 5, wherein each of said locking elements comprises a plate that at least partly overlies the respective elongate slot.

11. The item of furniture of claim 10, wherein the plate has a centreline and wherein the connection between the plate and a fixing is offset from the centreline.

12. The item of furniture of claim 7 comprising a cabinet.

* * * * *